US007225770B2

(12) United States Patent
Simpson

(10) Patent No.: US 7,225,770 B2
(45) Date of Patent: Jun. 5, 2007

(54) ELECTROMAGNETIC ACTUATOR HAVING INHERENTLY DECELERATING ACTUATION BETWEEN LIMITS

(75) Inventor: Roger T. Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 119 days.

(21) Appl. No.: 10/997,319

(22) Filed: Nov. 24, 2004

(65) Prior Publication Data

US 2005/0126521 A1 Jun. 16, 2005

Related U.S. Application Data

(60) Provisional application No. 60/528,465, filed on Dec. 10, 2003.

(51) Int. Cl.
*F01L 9/04* (2006.01)

(52) U.S. Cl. ..... 123/90.11; 251/129.01; 251/129.15

(58) Field of Classification Search ..... 123/90.11; 251/129.01, 129.02, 129.15, 129.16
See application file for complete search history.

(56) References Cited

U.S. PATENT DOCUMENTS

| | | | | |
|---|---|---|---|---|
| 3,938,483 | A | 2/1976 | Firey | 123/90.12 |
| 4,312,494 | A | 1/1982 | Aoyama | 251/48 |
| 4,320,371 | A | 3/1982 | Coyle et al. | 335/256 |
| 4,455,543 | A | 6/1984 | Pischinger et al. | 335/266 |
| 4,515,343 | A | 5/1985 | Pischinger et al. | 251/48 |
| 4,686,501 | A | 8/1987 | Palmier et al. | 335/256 |
| 4,749,167 | A | 6/1988 | Gottschall | 251/65 |
| 5,124,598 | A * | 6/1992 | Kawamura | 310/30 |
| 5,592,905 | A | 1/1997 | Born | 123/90.11 |
| 5,636,601 | A | 6/1997 | Moriya et al. | 123/90.11 |
| 5,638,781 | A | 6/1997 | Sturman | 123/90.12 |
| 5,647,311 | A | 7/1997 | Liang et al. | 123/90.11 |
| 5,671,705 | A | 9/1997 | Matsumoto et al. | 123/90.11 |
| 5,782,211 | A | 7/1998 | Kamimaru | 123/90.11 |
| 5,782,454 | A | 7/1998 | Bulgatz et al. | 251/129.1 |
| 5,878,704 | A | 3/1999 | Schebitz et al. | 123/90.11 |
| 5,904,226 | A | 5/1999 | Sakaguchi et al. | 184/67 |
| 6,003,481 | A | 12/1999 | Pischinger et al. | 123/90.11 |
| 6,016,778 | A | 1/2000 | Koch | 123/90.11 |

(Continued)

FOREIGN PATENT DOCUMENTS

| | | |
|---|---|---|
| DE | 3641108 | 6/1988 |

(Continued)

*Primary Examiner*—Ching Chang
(74) *Attorney, Agent, or Firm*—Brown & Michaels, PC; Greg Dziegielewski

(57) ABSTRACT

An electromagnetic valve actuator system for controlling the operation of a valve in an internal combustion engine comprising a valve having a valve stem with a valve head at one end. The valve is reciprocable along the longitudinal central axis of the valve stem to alternatingly move the valve head between a first position and a second position. A first coil is positioned on a first laminated core having a gap and a thickness. A second coil is positioned on a second laminated core having a gap and a thickness. The gaps of the first and second cores are aligned. An armature on the valve stem passes through the gaps of the first and second laminated cores, such that when the armature is centered in either of the gaps at least a portion of the armature extends slightly passed the thickness of the other laminated core.

8 Claims, 10 Drawing Sheets

U.S. PATENT DOCUMENTS

| | | | | |
|---|---|---|---|---|
| 6,024,059 | A | 2/2000 | Kamimaru et al. | 123/90.11 |
| 6,039,014 | A * | 3/2000 | Hoppie | 123/90.11 |
| 6,198,370 | B1 | 3/2001 | Schmitz | 335/256 |

FOREIGN PATENT DOCUMENTS

| | | |
|---|---|---|
| DE | 19712064 | 10/1998 |
| DE | 19714409 | 10/1998 |
| EP | 1215370 | 6/2002 |
| FR | 2808375 | 11/2001 |
| WO | WO 02/056321 | 7/2002 |
| WO | WO 2004/046511 | 6/2004 |

* cited by examiner

Fig. 7A
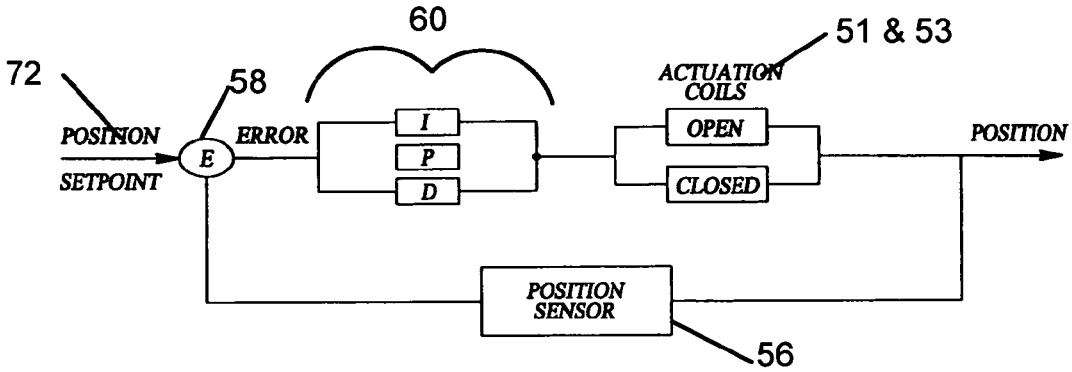
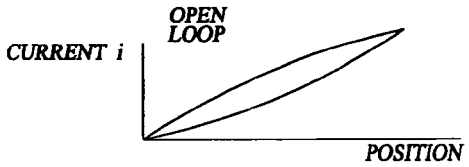
Fig. 7B
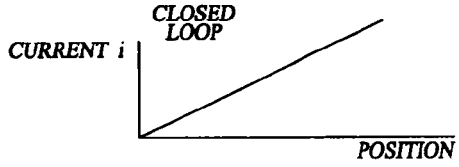
Fig. 7C

ELECTROMAGNETIC ACTUATOR HAVING INHERENTLY DECELERATING ACTUATION BETWEEN LIMITS

REFERENCE TO RELATED APPLICATIONS

This application claims an invention, which was disclosed in Provisional Application No. 60/528,465, filed Dec. 10, 2003, entitled "ELECTROMAGNETIC ACTUATOR HAVING INHERENTLY DECELERATING ACTUATION BETWEEN LIMITS". The benefit under 35 USC §119(e) of the United States provisional application is hereby claimed, and the aforementioned application is hereby incorporated herein by reference

BACKGROUND OF THE INVENTION

1. Field of the Invention

The present invention pertains to electromagnetic valve actuator systems. More particularly, the invention pertains to an electromagnetic valve actuator system that opens and closes the poppet valves of an internal combustion engine.

2. Description of Related Art

Conventionally, valve trains of internal combustion engines include poppet valves that are spring loaded toward a valve-closed position. The poppet valves are biased open either by an overhead camshaft mechanism or by a cam and push rod mechanism. In either case, the camshaft is connected to and rotates in synchronization with an engine crankshaft to open and close each valve at predetermined intervals as defined by the position of lobes on the camshaft. Therefore, the sequence and lift distance of each valve is fixed by the position and size of the lobes on the camshaft, and the frequency of the operation of each valve is proportional to engine crankshaft speed.

Such direct-drive arrangements fix valve train operation and thereby limits engine performance because ideal valve timing varies, and is not fixed, over the full range of engine speed. Therefore, it would be desirable to incorporate an indirect drive arrangement in which the valve train is not fixed, but is independently variable with respect to each valve. Such factors as lift distance, lift speed, and seating velocity could be varied independently for each valve. These factors can be varied to improve breathing of the engine to increase performance, fuel economy, or to reduce emissions. The variable cam timing (VCT) devices of the prior art allow for variable phasing of the valve train with respect to engine crankshaft speed, but do not allow for independent variability of the valves.

Because of the above-described limitation of VCT devices, many inventors have abandoned the direct drive and VCT architectures in favor of electromagnetic valve actuator systems. Such systems have the potential to increase overall engine efficiency by reducing frictional losses associated with the conventional valve train, and by reducing heavy components such as the camshaft, chain, sprockets, and VCT devices. Such systems are also capable of closing certain valves to permit the engine to operate as a "smaller", more efficient, engine under high speed/low torque conditions. Unfortunately, however, these electromagnetic valve trains have not gained widespread acceptance in the marketplace, primarily due to a substantial increase in part count, poor valve seating reliability, and increased noise, vibration, and harshness (NVH) during operation.

These actuator systems use flat disk-like armatures that are positively secured to the valve and are axially trapped between ring-like tractive electromagnets. The electromagnets have poles at one end that attract the armature to either an open or closed position against the respective poles of the electromagnets. Unfortunately, as the valve heats up under normal operating conditions, the valve expands in length and does not have a chance to seat before the armature stops against the respective pole. Additionally, increased NVH (noise, vibration, and hardness) results from the valve and armature colliding against their respective mating surfaces. This results because the force on the armature increases cubically as the distance between the armature and the pole decreases. Therefore, the armature is accelerating as it approaches the pole, and the force on the armature is at a maximum just as the armature makes contact with the pole.

A review of the prior art yields scores of electromagnetically actuator valve devices directed at remedying valve seating problems and NVH during operation. For example, U.S. Pat. No. 4,455,543 (Pischinger et al.) and U.S. Pat. No. 4,749,167 (Gottschall) use spring systems attached to electromagnet armatures to decelerate a valve to the full open or closed position. U.S. Pat. No. 4,515,343 (Pischinger et al.) uses a bellows device mounted coaxially within an electromagnetic actuator to adjust the distance between the valve seat and the electromagnet pole so that it corresponds to the distance between the valve head and the electromagnet armature, so that a desired amount of dampening is consistently achieved. U.S. Pat. No. 5,878,704 (Schebrtz et al.) uses a sound muffling layer sandwiched between the electromagnets of the electromagnetic actuator to absorb vibration from the armature slapping against the poles of the electromagnets. U.S. Pat. No. 5,592,905 (Bam) replaces heavy iron armatures with a lightweight conductive armature that is finely controlled by varying current supplied to the armature. U.S. Pat. No. 5,647,311 (Liang et al.) and U.S. Pat. No. 6,003,481 (Pischinger et al.) each use at least one auxiliary electromagnet and armature to provide additional control of the closing force of the valve. Finally, U.S. Pat. No. 5,636,601 (Moriya et al.), U.S. Pat. No. 5,671,705 (Natsumoto et al.), and U.S. Pat. No. 6,016,778 (Koch) use control circuits to vary the current supplied to the electromagnets in accordance with varying operational temperatures to gain a more controlled seating of the valve.

All of the above-listed references have significant disadvantages that render their use unlikely in the marketplace. First, some are limited to a single valve lift distance, and thus do not fully take advantage of potential engine efficiencies and operate on a fixed disk-like armature that may seat against the electromagnet pole before the valve head seats with the valve seat. Others involve expensive additional components such as bellows, current carrying armatures, muffling devices, and additional electromagnets and armatures. Finally, others incorporate complex control circuits to bandage the inherent hardware problems of the prior art. Such control schemes face the difficult task in reducing current to the electromagnet fast enough to slow the accelerating armature.

SUMMARY OF THE INVENTION

An electromagnetic valve actuator system for controlling the operation of a valve in an internal combustion engine comprising a valve having a valve stem with a valve head at one end. The valve is reciprocable along the longitudinal central axis of the valve stem to alternatingly move the valve head between a first position and a second position. A first coil is positioned on a first laminated core having a gap and a thickness. A second coil is positioned on a second laminated core having a gap and a thickness. The gaps of the first and second cores are aligned. An armature on the valve stem passes through the gaps of the first and second laminated cores, such that when the armature is centered in either of the gaps at least a portion of the armature extends slightly passed the thickness of the other laminated core.

BRIEF DESCRIPTION OF THE DRAWING

FIGS. 7A, 7B, and 7C show a schematic view of a control system for controlling the operation of the present invention and the relationships of current versus position in open and closed loop systems.

DETAILED DESCRIPTION OF THE INVENTION

Figure 1:
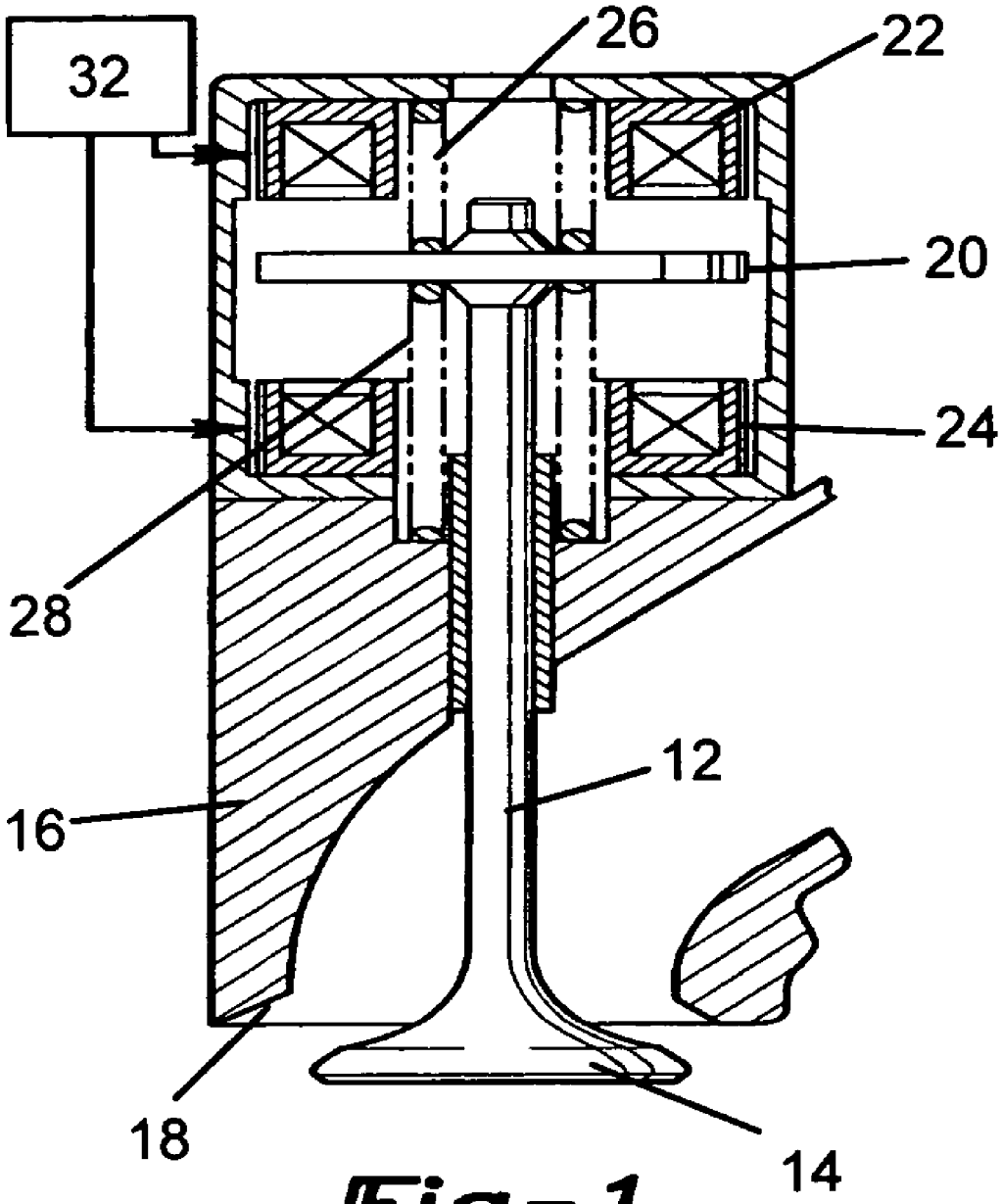
Fig-1 PRIOR ART
FIG. 1 shows a schematic elevation view, partly in cross-section, of an electronic valve actuator (EVA) system according to the prior art.
Figure 2:
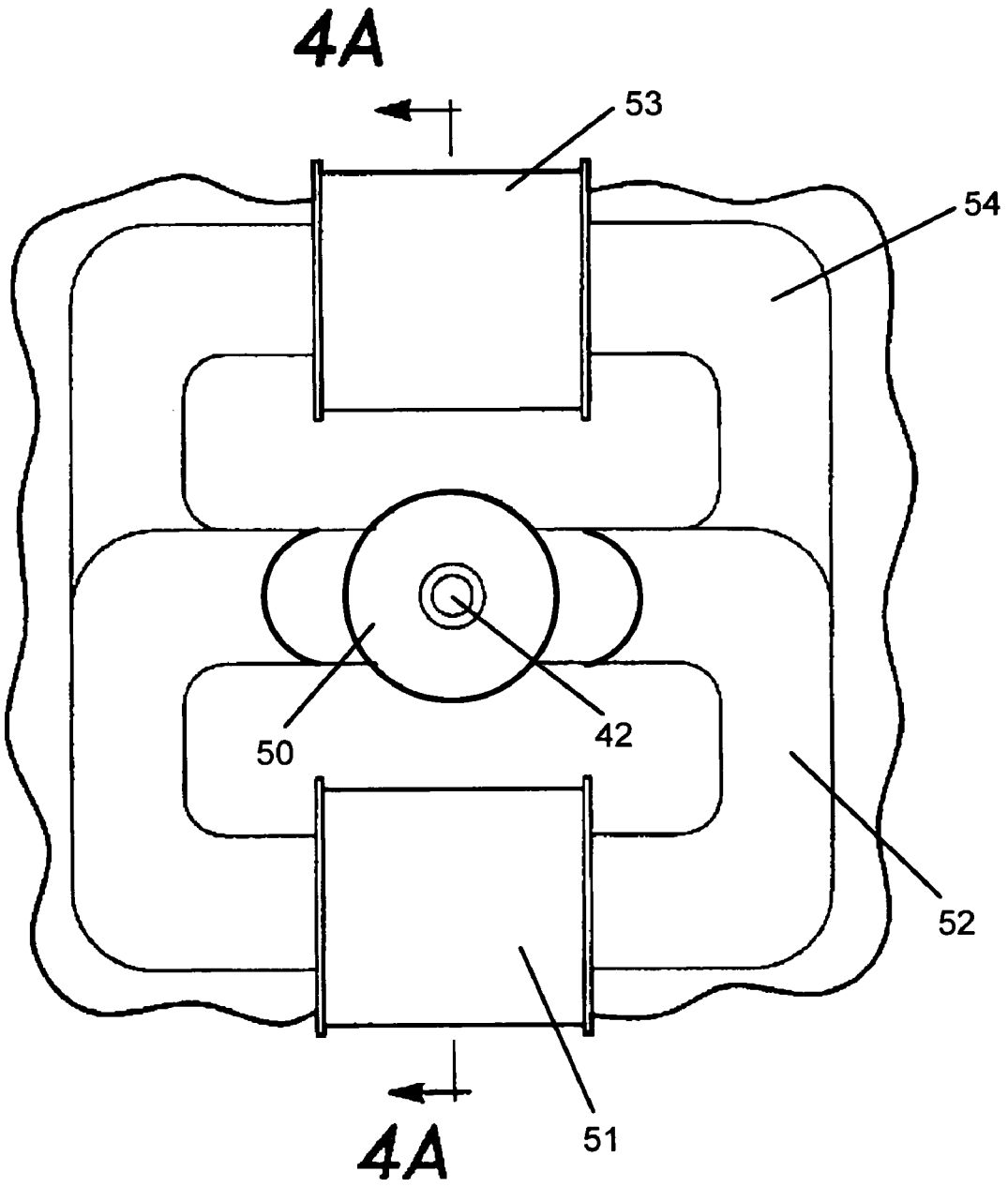
FIG. 2 shows a top view of the electronic valve actuator system (EVA) according to the present invention.
Figure 3:
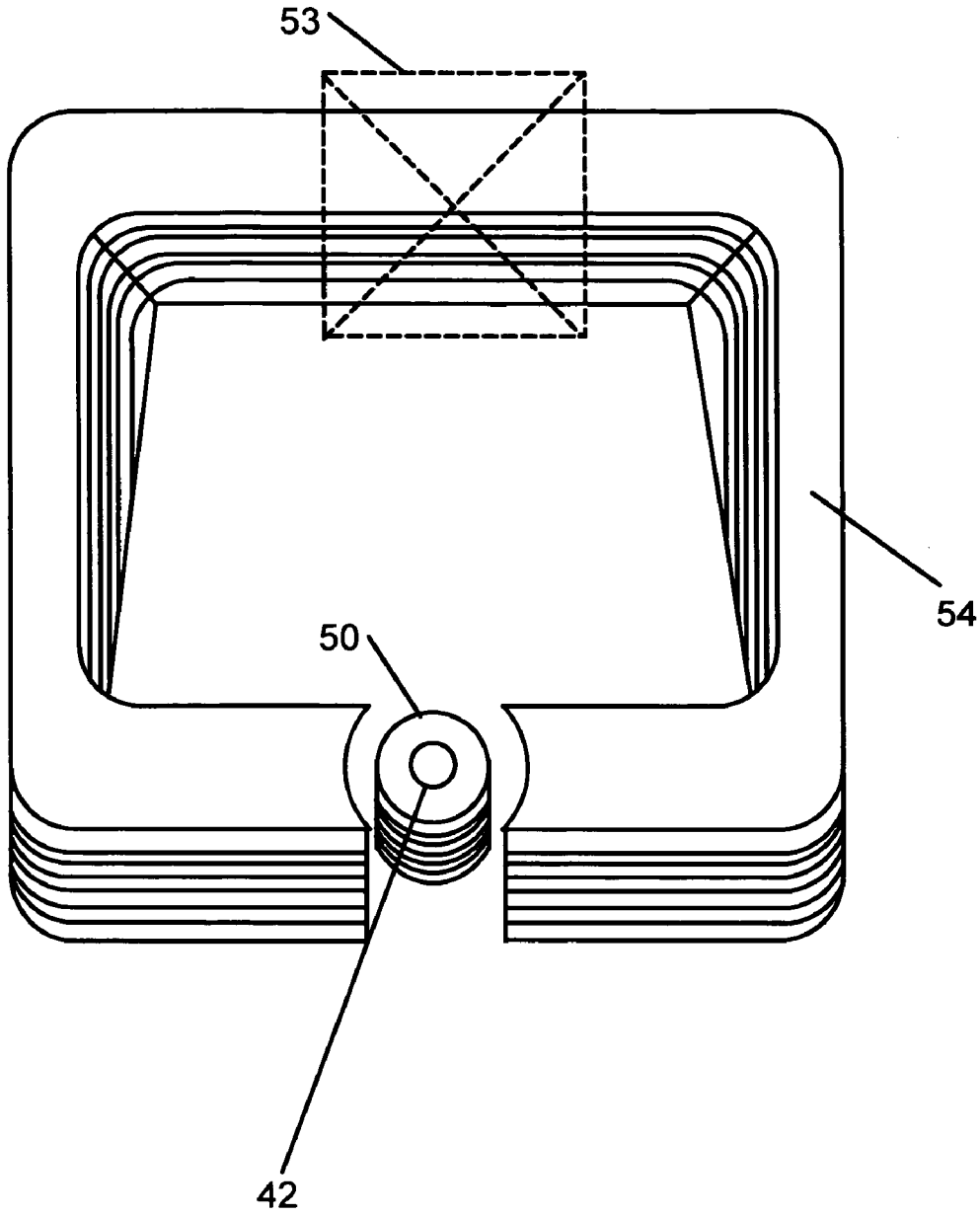
FIG. 3 shows a perspective view of the EVA system of FIG. 2.

Prior art FIG. 1 illustrates a known electronic valve actuator (EVA) system in an internal combustion engine, in which a valve stem 12 with an integral head 14 reciprocates within an engine block 16. The reciprocation of the valve stem 12 is effective to alternately bring the valve head 14 into a closed position and an open position, in the closed position, the valve head 14 seats against a valve seat 18 of the engine block 16. In the open position, which is shown in prior art FIG. 1, the valve head 14 is away from the seat 18, preventing or permitting flow into or out of a cylinder (not shown) with which the valve stem 12 is associated. The valve stem 12 carries an armature 20, and reciprocation of the valve stem 12 is caused by the energization of one or another of spaced-apart, annular or U-shaped electromagnetic coils 22, 24 on opposed sides of the armature 20. When neither of the coils 22, 24 is energized, the valve stem 12 is biased toward a neutral or equilibrium position, which is between its closed and fully opened positions by compression springs 26, 28 that act on opposed sides of the armature 20. The valve head 14 is drawn to its closed position by energizing the coil 22, which will draw the armature 20 towards itself and is drawn to its opened position by energizing the coil 24, which will draw the armature 20 toward itself. The rate of movement of the armature toward the closed position of the valve head 14 is retarded by an increase in the force imposed on the armature 20 by the compression spring 26 relative to that imposed on the armature 20 by the compression spring 28, to thereby soften any impact at valve closing by the valve head 14 against the valve seat 18. The coils 22, 24 are selectively energized by current from the control circuit 32.

Prior art FIG. 1 requires two springs to ensure proper operation and this is a mechanical complexity that detracts from the cost effectiveness of the invention of such embodiment. Further, the load imposed on the armature 20 by the coils 22 and 24 is an inverse function of the first power of the distance between the armature 20 and the coils 22 and 24. That is, the force of the armature is greater at the end of travel, when the armature is closest to coils 22 and 24. Further, because of the relatively high speed of operation of an internal combustion engine valve, it is difficult to control an electromagnetic force on the valve 12 by reducing current to the coil 22 as the armature 20 is drawn to the coil 22 by electrical power flowing therethrough. To overcome these problems, it is necessary that the armature 20 be spaced from the coil 22 by a fairly substantial distance in the fully seated position of the valve 14, and this requires a somewhat longer than desired valve stem 12, and detracts from the packaging effectiveness of the system of prior art FIG. 1.

FIGS. 2, 3, 4A, and 4B show an electronic valve actuator system (EVA) for an internal combustion engine, comprising a valve stem 42 having an integral head 44 that reciprocates within the engine block 46. The valve stem 42 passes through a gap in the laminated cores 52, 54. The laminated cores 52, 54 each contain electromagnetic coils 51, 53. Valve guides 56, keep the valve stem 42 aligned between the two electromagnetic coils 51, 53. The valve guides 56 may be bearings, or preferably be position sensors, for example piezoelectric position sensors. In between the valve guides 56, mounted to the stem 42, is armature 50.

The closed control loop for the position sensor, preferably piezoelectric position sensor is shown in FIG. 7A. The sensor 56 is adjusted by a set point 72 imposed on error detector 58. The error detector 58 produces an error signal that is based on the position deviation of the valve stem 42 from its open position, as shown in FIG. 4B. The error signal is then sent to driver 60. The driver 60 imposes a signal on the coils 51, 53, causing energization or denergization of the coils to cause the valve be in either open or closed position. This signal is then sent back to the position sensor 56. FIG. 7B shows the relationship of current versus position in an open loop system. In the open loop system, some hysteresis is present, when the valve moves to the open and closed positions. FIG. 7C shows the relationship of current versus position in a closed loop system. Hysteresis is not present.

Figure 4A:
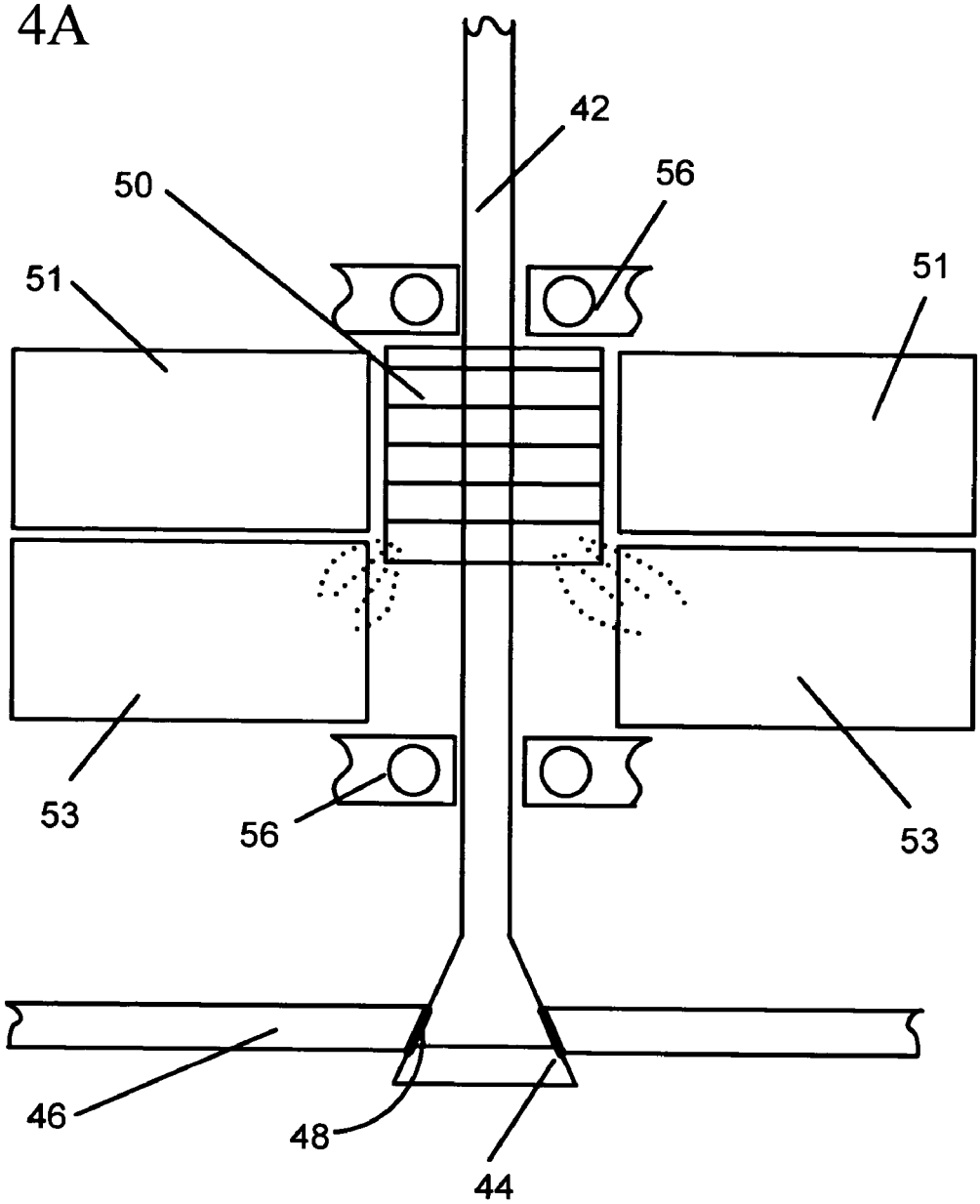
FIGS. 4A, and 4B show a sectional view taken along line 4A-4A of FIG. 2, showing the engine valve closed and open respectively.
Figure 4B:
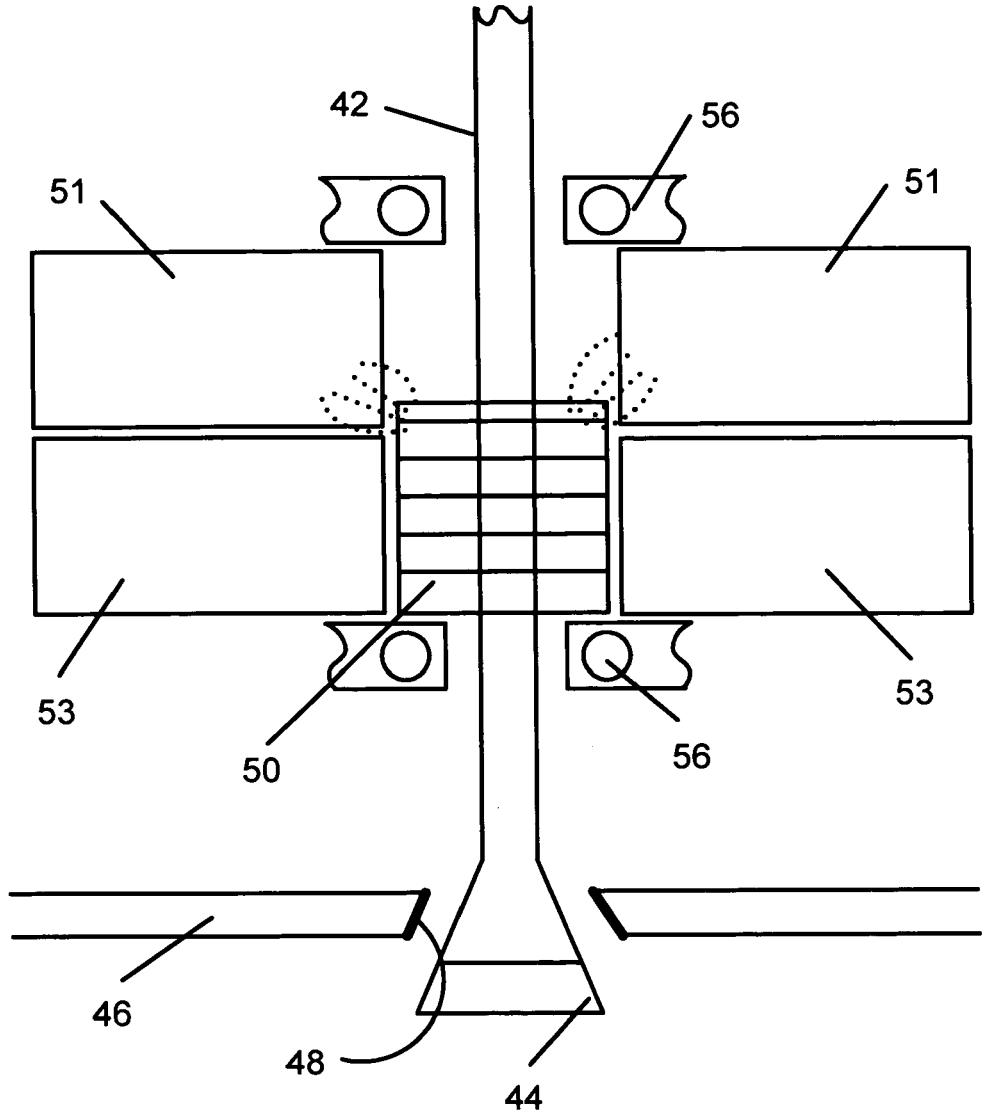
Figure 8:
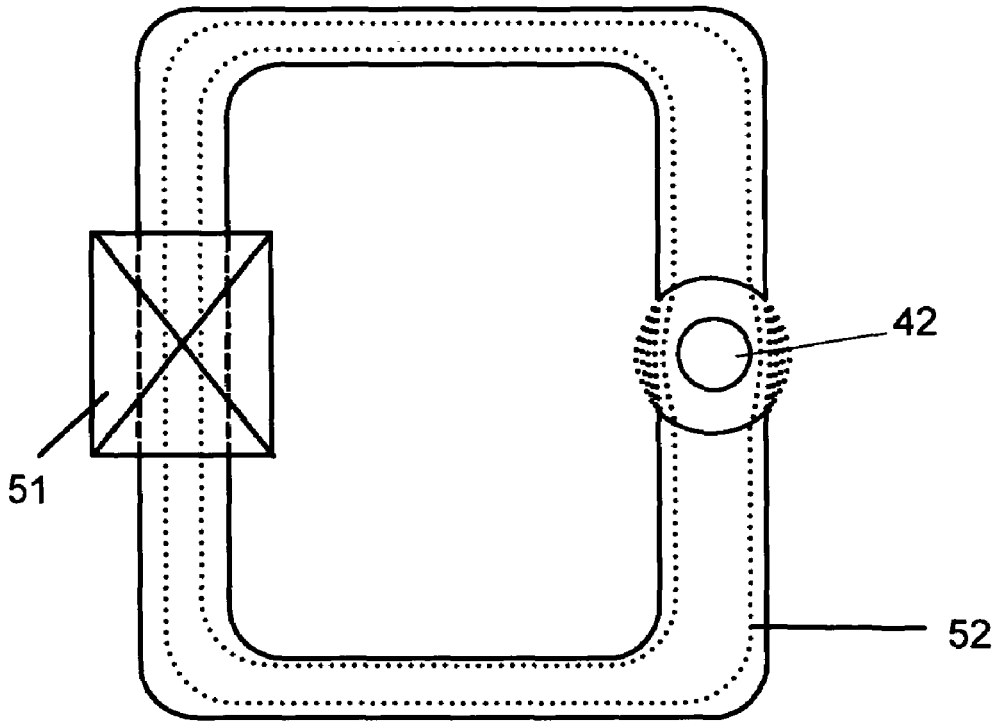
FIG. 8 shows a top down view of the top laminated core including the path of magnetic force.
Figure 9:
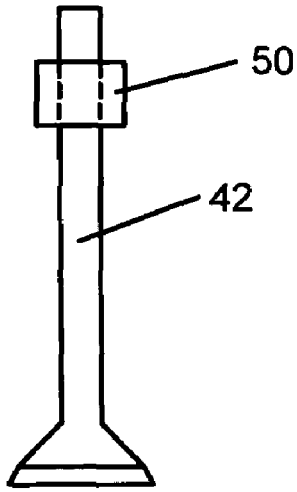
FIG. 9 shows a schematic of the relationship between the valve stem and the armature of the electronic valve actuator system of the present invention.

As shown in FIGS. 4A and 4B, the valve has two positions, open and closed. In the closed position, shown in FIG. 4A, the top electromagnetic coil 51 is energized, attracting the armature 50 mountably attached to the valve stem 42, as shown in FIG. 9, towards the top coil 51 such that the integral head 44 is in contact with the engine block. Magnetic force on the armature 50 increases until the armature is centered between the top set of magnetic coils 51, where the magnetic force is zero. An example of the path of magnetic force in an electromagnetic coil when it is energized is shown in FIG. 8. A small portion of the armature is exposed to the bottom set of coils 53 and a small magnetic force is present. However, the magnetic force is not great enough to move the armature 50 when the top set of coils 51 are on and the bottom set of coils 53 are off.

In the open position, shown in FIG. 4B, the bottom electromagnetic coil 53 is energized, attracting the armature 50 mountable attached to the valve stem 42 towards the bottom coil 53, causing integral head to disengage the engine block. Magnetic force on the armature 50 increases until the armature is centered between the bottom set of coils 53, where the magnetic force is zero. An example of the path of magnetic force in an electromagnetic coil when it is energized is shown in FIG. 8. A small portion of the armature is exposed to the top set of coils 51 and a small magnetic force is present. However, the magnetic force is not great enough to move the armature 50 when the bottom set of coils 53 are on and the top set of coils 51 are off.

Figure 5:
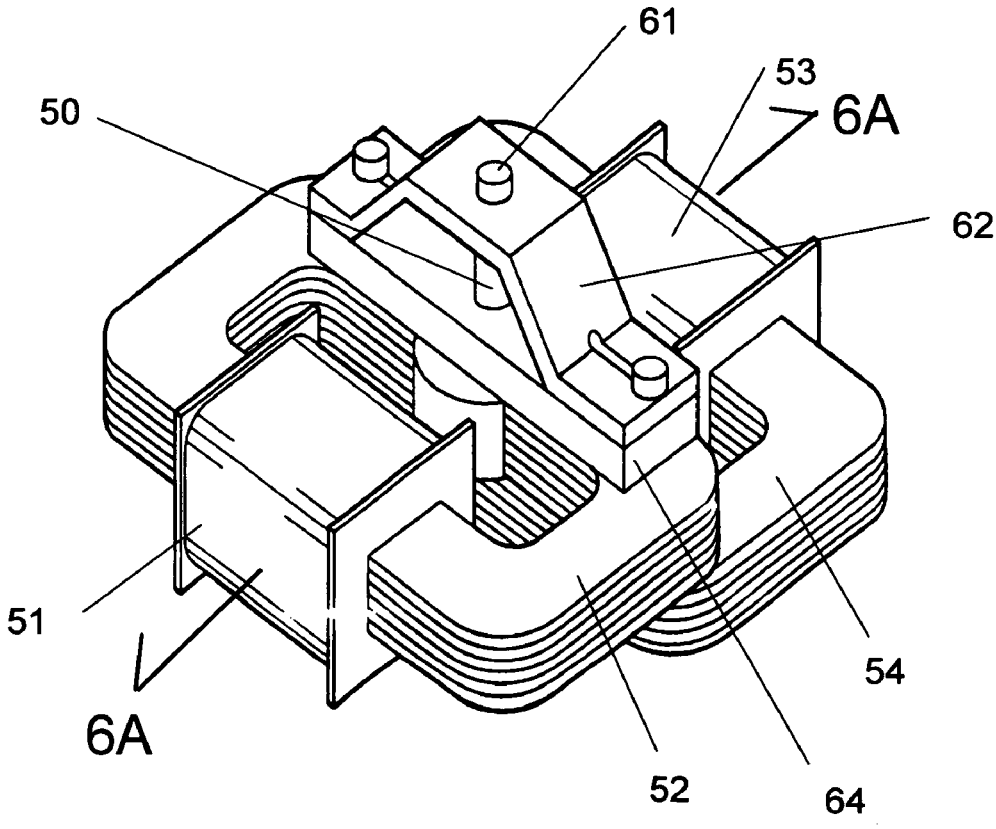
FIG. 5 shows a top view of an electronic valve actuator system according to an alternative embodiment.
Figure 6A:
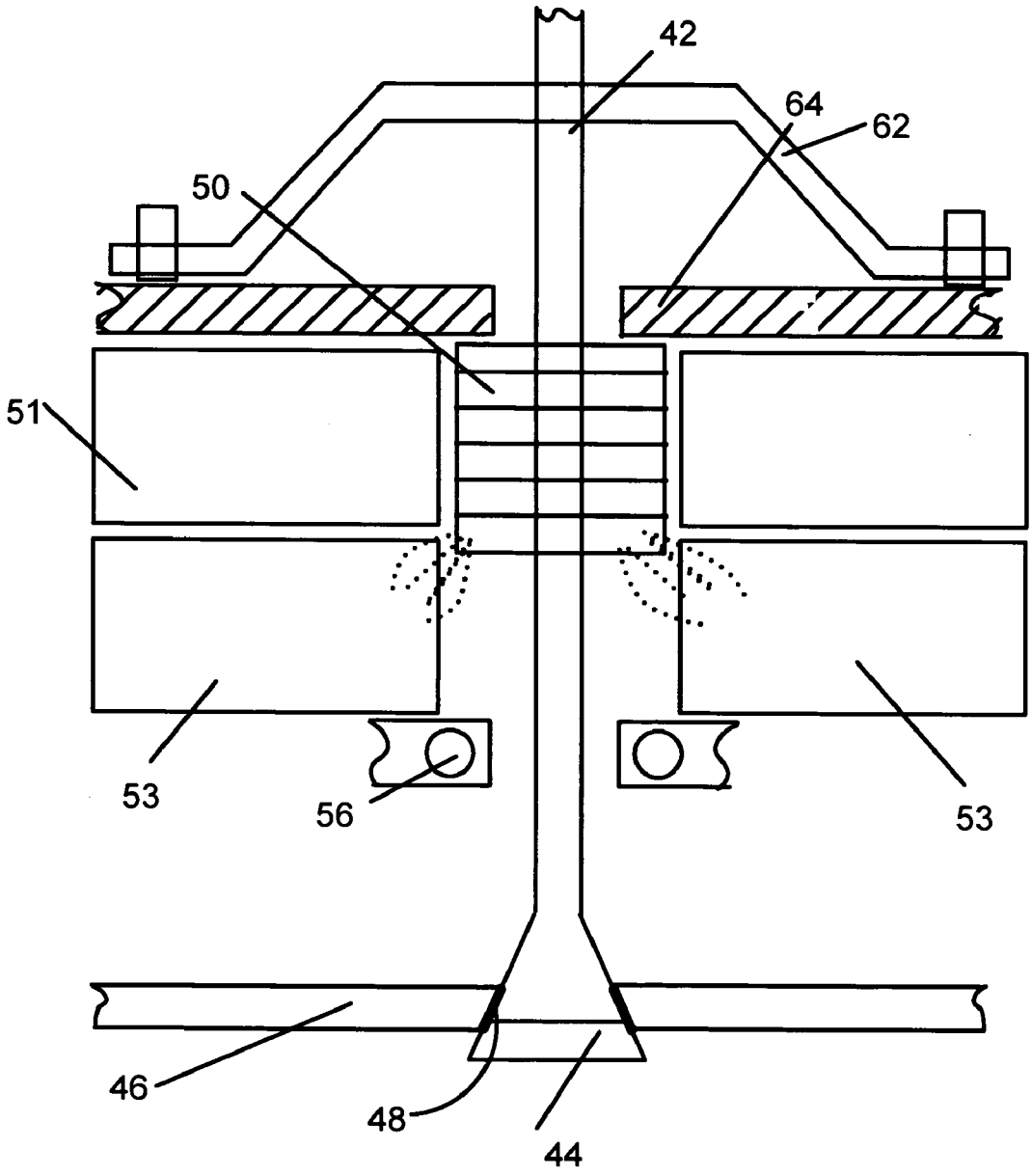
FIGS. 6A and 6B show a sectional view taken along line 6A-6A of FIG. 5, showing the engine valve closed and open respectively in an alternative embodiment of the present invention.
Figure 6B:
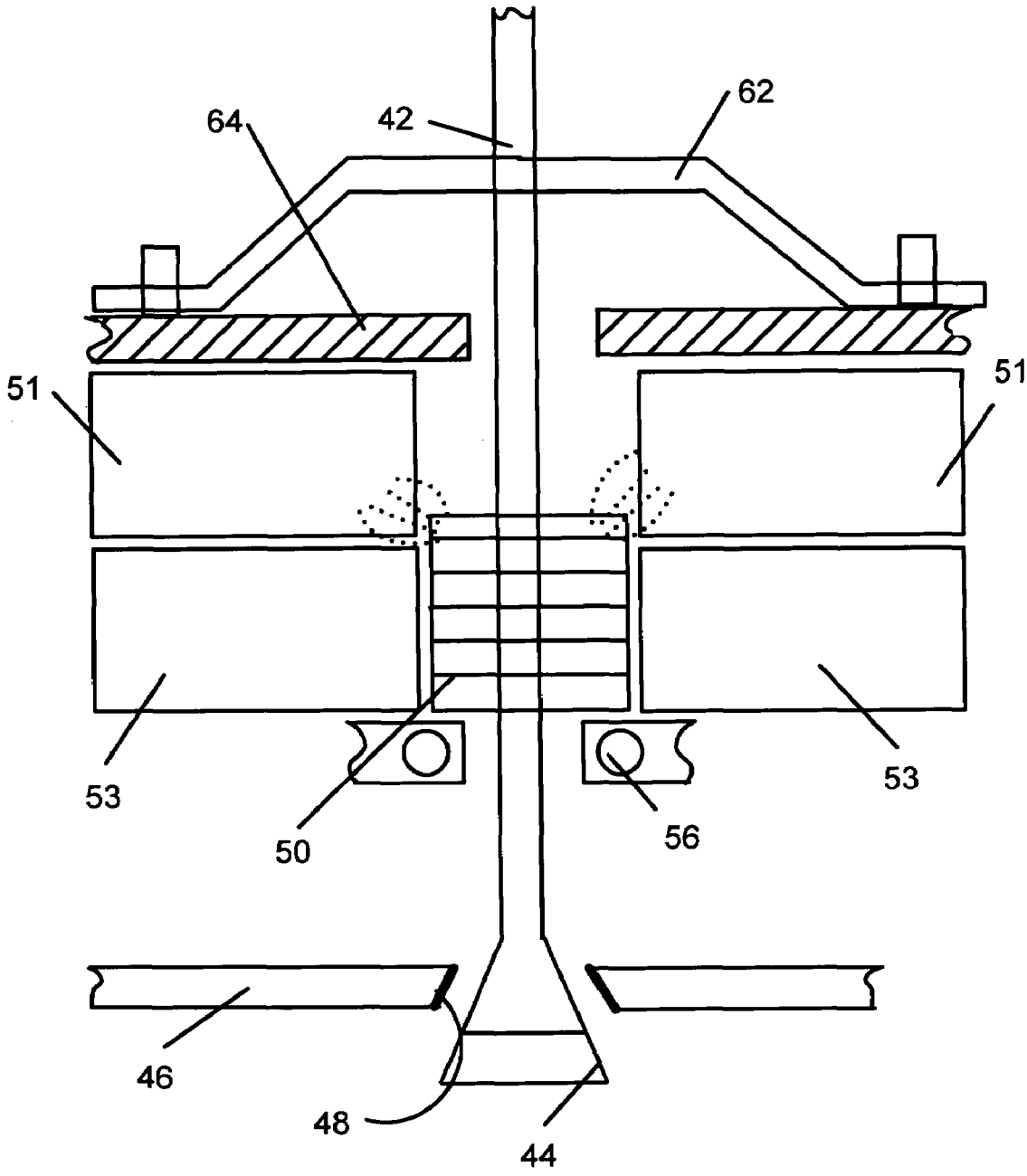

FIGS. 5, 6A, and 6B show an alternative electronic valve actuator system (EVA) for an internal combustion engine. In this embodiment, a strap drive return spring 62 rests on top of spacer 64 and is present as a precautionary fail safe, closing the valves in this case that the system fails or power is turned off. The electronic valve actuator system (EVA) opens and closes the valves in a manner similar to that disclosed in the previous embodiment and is repeated here by reference.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An electromagnetic valve actuator (EVA) system for controlling the operation of a valve in an internal combustion engine comprising a valve having a valve stem with a valve head at one end, the valve being reciprocable along a longitudinal central axis of the stem to alternatingly move the head between a first position and a second position, the electromagnetic valve actuator system comprising:

a first coil positioned on a first laminated core having a gap and a thickness;

a second coil positioned on a second laminated core having a gap and a thickness, the gap in the first laminated core and the gap in the second laminated core being aligned;

an armature on the valve stem and reciprocable therewith passing through the gap of the first laminated core and the gap of the second laminated core, such that when more than half of the armature is centered in either the gap of the first laminated core or the gap of the second laminated core, at least a portion of the armature extends slightly past the thickness of the first laminated core or the thickness of the second laminated core, respectively, and is exposed to a small magnetic force: and wherein when more than half of the armature is centered in the gap of the first laminated core, and the second laminated core is energized, the magnetic force on the armature increases until more than half of the armature is centered in the gap of the second laminated core and the magnetic force is zero;

wherein when more than half of the armature is centered in the gap of the second laminated core, and the first laminated core is energized, the magnetic force on the armature increases until more than half of the armature is centered in the gap of the first laminated core, and the magnetic force is zero.

2. The electromagnetic valve actuator system of claim 1, wherein in the first position the valve head of the valve contacts an engine block.

3. The electromagnetic valve actuator system of claim 2, wherein the valve is closed in the first position.

4. The electromagnetic valve actuator system of claim 1, wherein in the second position the valve head of the valve does not contact an engine block.

5. The electromagnetic valve actuator system of claim 4, wherein the valve is open in the second position.

6. The electromagnetic valve actuator system of claim 1, further comprising a strap drive-type return spring coupled to the valve stem.

7. The electromagnetic valve actuator system of claim 1, further comprising a position sensor for sensing the position of the valve stem as it translates between the first position and the second position.

8. The electromagnetic valve actuator system of claim 1, further comprising a control system for controlling energization of the first coil and second coil as a function of a signal from the position sensor.

* * * * *